US009951577B2

(12) United States Patent
McMiles

(10) Patent No.: US 9,951,577 B2
(45) Date of Patent: Apr. 24, 2018

(54) EMERGENCY WELLBORE INTERVENTION SYSTEM

(71) Applicant: Barry McMiles, Silva Jardim (BR)

(72) Inventor: Barry McMiles, Silva Jardim (BR)

( * ) Notice: Subject to any disclaimer, the term of this patent is extended or adjusted under 35 U.S.C. 154(b) by 0 days.

(21) Appl. No.: 14/969,238

(22) Filed: Dec. 15, 2015

(65) Prior Publication Data

US 2016/0168940 A1 Jun. 16, 2016

Related U.S. Application Data

(60) Provisional application No. 62/091,891, filed on Dec. 15, 2014.

(51) Int. Cl.

| | |
|---|---|
| ***E21B 33/064*** | (2006.01) |
| ***E21B 34/04*** | (2006.01) |
| ***E21B 41/00*** | (2006.01) |
| ***E21B 21/00*** | (2006.01) |

(52) U.S. Cl.

CPC ..... *E21B 33/064* (2013.01); *E21B 21/001* (2013.01); *E21B 34/04* (2013.01); *E21B 41/0007* (2013.01)

(58) Field of Classification Search

CPC ..... E21B 21/001; E21B 33/064; E21B 34/04; E21B 41/0007

See application file for complete search history.

(56) References Cited

U.S. PATENT DOCUMENTS

| | | | | |
|---|---|---|---|---|
| 3,163,224 | A * | 12/1964 | Haeber et al. | E21B 33/0355 166/345 |
| 3,698,474 | A * | 10/1972 | Rowley | E21B 33/068 137/1 |
| 5,727,640 | A * | 3/1998 | Gleditsch | E21B 33/0355 166/358 |
| 5,848,656 | A * | 12/1998 | Møksvold | E21B 21/001 175/7 |
| 2012/0145406 | A1* | 6/2012 | Kotrla | E21B 33/064 166/344 |
| 2015/0292291 | A1* | 10/2015 | Donald | E21B 33/076 166/368 |
| 2016/0222745 | A1* | 8/2016 | Wright | H01L 29/78603 |

* cited by examiner

*Primary Examiner* — James G Sayre

(74) *Attorney, Agent, or Firm* — The Petruzzi Law Firm; James D. Petruzzi

(57) ABSTRACT

An emergency wellbore intervention assembly connected to a BOP having a first generally L-shaped gate valve with a first and second port on each end of the L, each side operably connected to an actuator connectable to a hydraulic control line for selectable fluid communication with a pipe, the first port connected to a choke line, and the second port connected above a lower shear ram of a BOP, the first gate valve in selectable fluid communication with the pipe to a second similar two valve assembly operably connected to a kill line and below the lower shear ram and a manually operated valve operably connected to the second gate valve for fluid engagement to a high pressure fluid source. A method for controlling a well using the two valve assemblies by selectively plugging the well and circulating fluid from the kill side to the choke side of the system.

18 Claims, 3 Drawing Sheets

SECTION A-A

EMERGENCY WELLBORE INTERVENTION SYSTEM

CROSS REFERENCE TO RELATED APPLICATION

This application takes priority from provisional application Ser. No. 62/091,891 entitled "Emergency Wellbore Intervention System" filed Dec. 15, 2014 and is incorporated as if fully set forth herein.

STATEMENT REGARDING FEDERALLY SPONSORED RESEARCH OR DEVELOPMENT

Not applicable

DESCRIPTION OF ATTACHED APPENDIX

Not applicable

BACKGROUND OF THE INVENTION

This invention relates generally to the field of subsea systems, and more particularly to an Emergency Wellbore Intervention System.

As seen during the BP Maconda incident and consequent environmental damage, and other subsea oil operations, emergency well kills, when the drilling rig has lost the connection with a flowing well, consists of capping and drilling a relief well to kill the flow further down the well. Depending on the situation, this can be an extremely time consuming, expensive operation with sometimes uncertain results. Not only is the environment affected, livelihoods are disrupted and the economics of the affected area can end up having catastrophic outcomes.

The emergency wellbore intervention system of the present invention can reduce all of these problems, especially the time the wellbore fluid is flowing uncontrolled into the environment and polluting the area. It also allows for more time to ready the drilling of the relief well ensuring success or may even make drilling a relief well not even necessary. This can be easily fitted to an existing system with very little modification and can be done without requiring a shipyard visit.

BRIEF SUMMARY OF THE INVENTION

It is an advantage of the invention to provide an improved emergency relief system for controlling subsea oil wells.

It is another advantage of the invention to provide a method for controlling subsea oil wells.

It is yet another advantage of the invention to provide a reciprocal pair of valve assemblies for attachment to a BOP for the efficient control of fluid flow.

Other objects and advantages of the present invention will become apparent from the following descriptions, taken in connection with the accompanying drawings, wherein, by way of illustration and examples, an embodiment of the present invention is disclosed.

In accordance with a preferred embodiment of the invention, there is shown an emergency gate valve intervention assembly having a first generally L-shaped gate valve having two ports on each end of the L, each side operably connected to an actuator connectable to a hydraulic control line for selectable fluid communication with a pipe, the first gate valve in selectable fluid communication with the pipe to a second generally L-shaped gate valve in selectable fluid communication with the pipe, the second valve having two ports on each side of the L, each operably connected to an actuator connectable to a hydraulic control line for selective fluid communication to the pipe, and a manually operated valve operably connected to the second gate valve for fluid engagement to a high pressure fluid source.

In accordance with another preferred embodiment of the invention, there is shown an emergency wellbore intervention assembly connected to a blow out protector (BOP) having an upper and lower shear ram having a first generally L-shaped gate valve having a first and second port on each end of the L, each side operably connected to an actuator connectable to a hydraulic control line for selectable fluid communication with a pipe, the first port connected to a choke line, and the second port connected above a lower shear ram of a BOP, the first gate valve in selectable fluid communication with the pipe to a second generally L-shaped gate valve in selectable fluid communication with the pipe, the second valve having a third and fourth port on each side of the L, each operably connected to an actuator connectable to a hydraulic control line for selective fluid communication to the pipe, the third port connected to a kill line and the fourth port connected below the lower shear ram of a BOP, and a manually operated valve operably connected to the second gate valve for fluid engagement to a high pressure fluid source.

In accordance with yet another preferred embodiment of the invention, there is shown a method for use of an emergency wellbore intervention assembly on a blow out preventer (BOP) having an annulus with drill pipe disposed therein comprising the steps of plugging the annulus with pumping fluid above the lower shear ram to prevent fluid flow, measuring the drill pipe pressure and choke line pressures, calculating the mud weight to kill and stabilize the well based on the drill pipe pressure, engaging below a lower shear ram and above a pipe ram on a kill side of a BOP a first generally L-shaped gate valve having a first and second port on each end of the L, the gate valve selectively operable by an actuator controlled by a hydraulic line to engage the BOP through said second port, applying kill mud from a high pressure source through a second L-shaped gate valve in fluid communication with the first L-shaped gate valve, and engaging a third L-shaped gate valve having a third and fourth port on a choke side of the BOP, the fourth port below the lower shear ram to create a flow path to a choke line in fluid communication with the fourth port upon engagement of the third gate valve to permit flow of kill mud to the surface through a choke line established through the fourth port.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated, out of phase or enlarged to facilitate an understanding of the invention.

DETAILED DESCRIPTION OF THE PREFERRED EMBODIMENTS

Figure 1A:
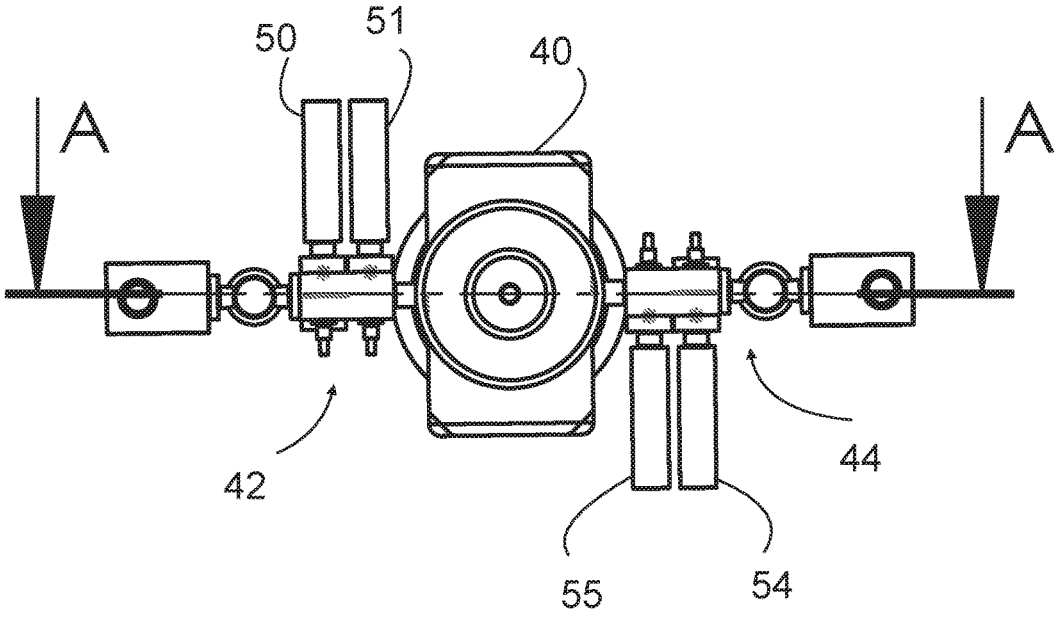
FIG. 1A shows a top plan view of a BOP and gate valve intervention assemblies according to a preferred embodiment of the invention.

Referring now to FIG. 1A, there is shown a top down plan view of a blow out protector (BOP) 40 and gate valve intervention assemblies 42 and 44 situated on opposite sides of the BOP at different engagement points. Actuators 50, 51, 54, and 55 are shown and more fully described in connection with FIG. 2. Cross sectional view along A-A is further depicted in FIG. 1B.

Figure 1B:
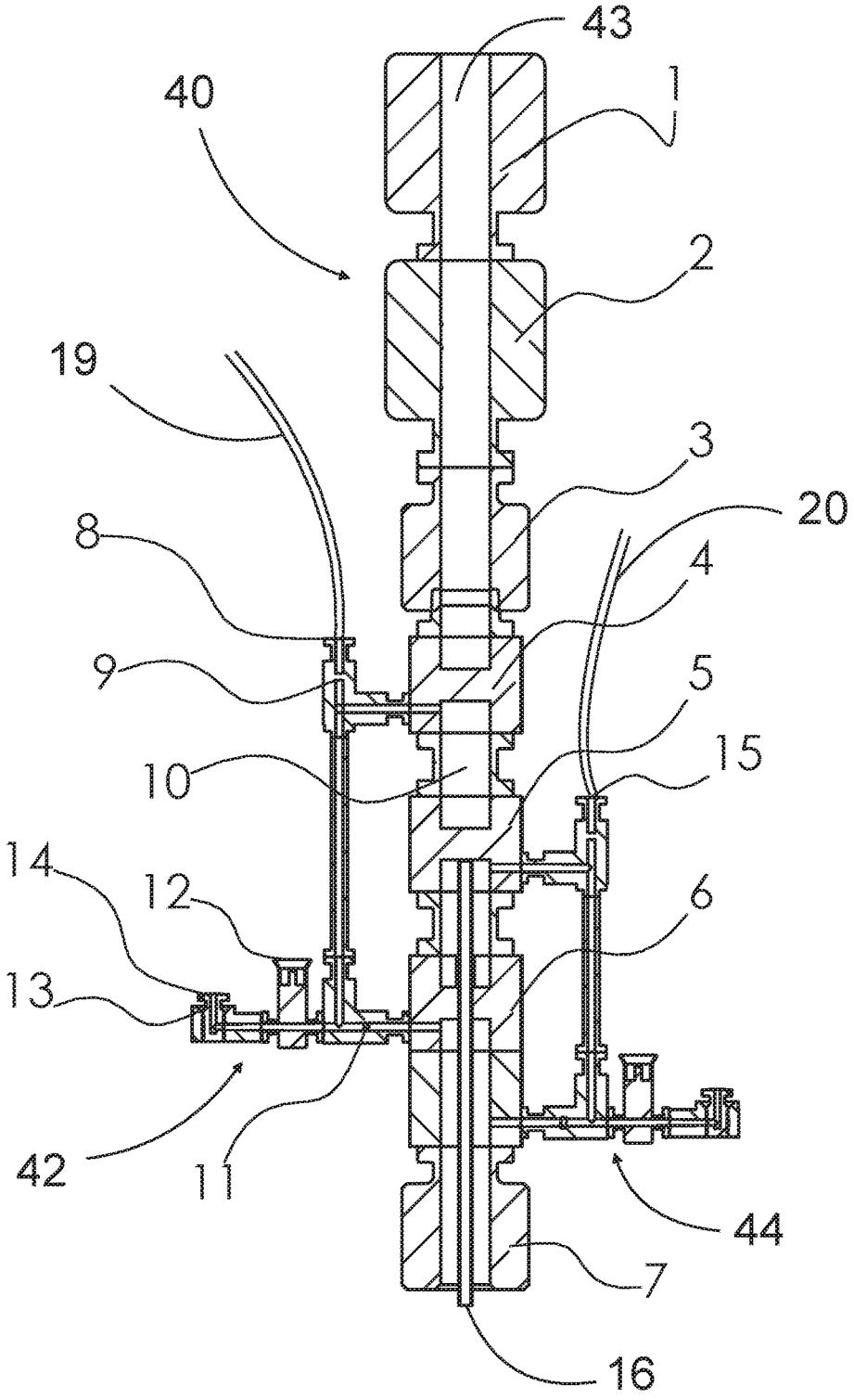
FIG. 1B shows a cross sectional view of a gate valve intervention assemblies along A-A of FIG. 1A according to a preferred embodiment of the invention.

FIG. 1B shows a cross sectional view of FIG. 1A along line A-A. BOP 40 is typically comprised of a series of stacked members including annulars 1 and 2, lower marine riser package (LMRP) connector 3, upper shear ram 4, lower shear ram 5, pipe rams 6, and drill pipe 16, all connected to wellhead connector 7. Annulus 43 runs down BOP 40 and has disposed within it drill pipe 16 in a manner well know to those of skill in the art. Casing, not shown, about the drill pipe is also typically placed for conventional drilling operations.

Situated on opposite sides of BOP 40 are gate valve intervention assemblies 42 and 44 according to a preferred embodiment of the invention. Gate valve assembly 42 normally is attached to a choke connector 8 that in turn is connected by auxiliary lines 19 to the surface rig (not shown), whereas gate valve intervention assembly 44 is similarly connected to the kill line at kill line connector 15 via auxiliary lines 20 to the rig.

The invention is preferably used during abnormal operations where such normal controls are no longer available. Although the following description is for gate valve assembly 42, the same description of the valve configuration and interconnection to other portions of the assembly applies to gate valve intervention assembly 44. As further discussed below, in operation, they activate in different sequences, and are positioned in different locations on the BOP 40 and in some uses have different operation.

Gate valve 9 is preferably positioned between upper shear ram 4 and lower shear ram 5 and is operably connected and in fluid communication to annulus 43 in BOP 40. Connected to gate valve 9 are two actuators (not shown) and more fully described in connection with FIG. 2. Spool or pipe 53 (See FIG. 2) connects gate valve 11 to gate valve 9, and gate valve 11 is preferably operably connected to the annulus in BOP 40 below lower shear ram 5.

Operably connected to gate valve 11 is manually operated gate valve 12 which is activated preferably by remote operated vehicle (ROV). Gate valve 12 is in turn connected to a fluid inlet/outlet port 13 connected to hose connector 14 for connection to a high pressure pump. Gate valve 11 is connected through port 59 (shown in FIG. 2) into the BOP 40.

In all respects, gate valve intervention assembly 44 is similarly configured to gate valve intervention assembly 42, although it is connected to a kill line through kill line connector 15 and situated below lower shear ram 5 on its upper gate valve. The lower gate valve, reciprocal to gate valve 11 is positioned below pipe ram 6. Operation of the two assemblies is further described below.

Figure 2:
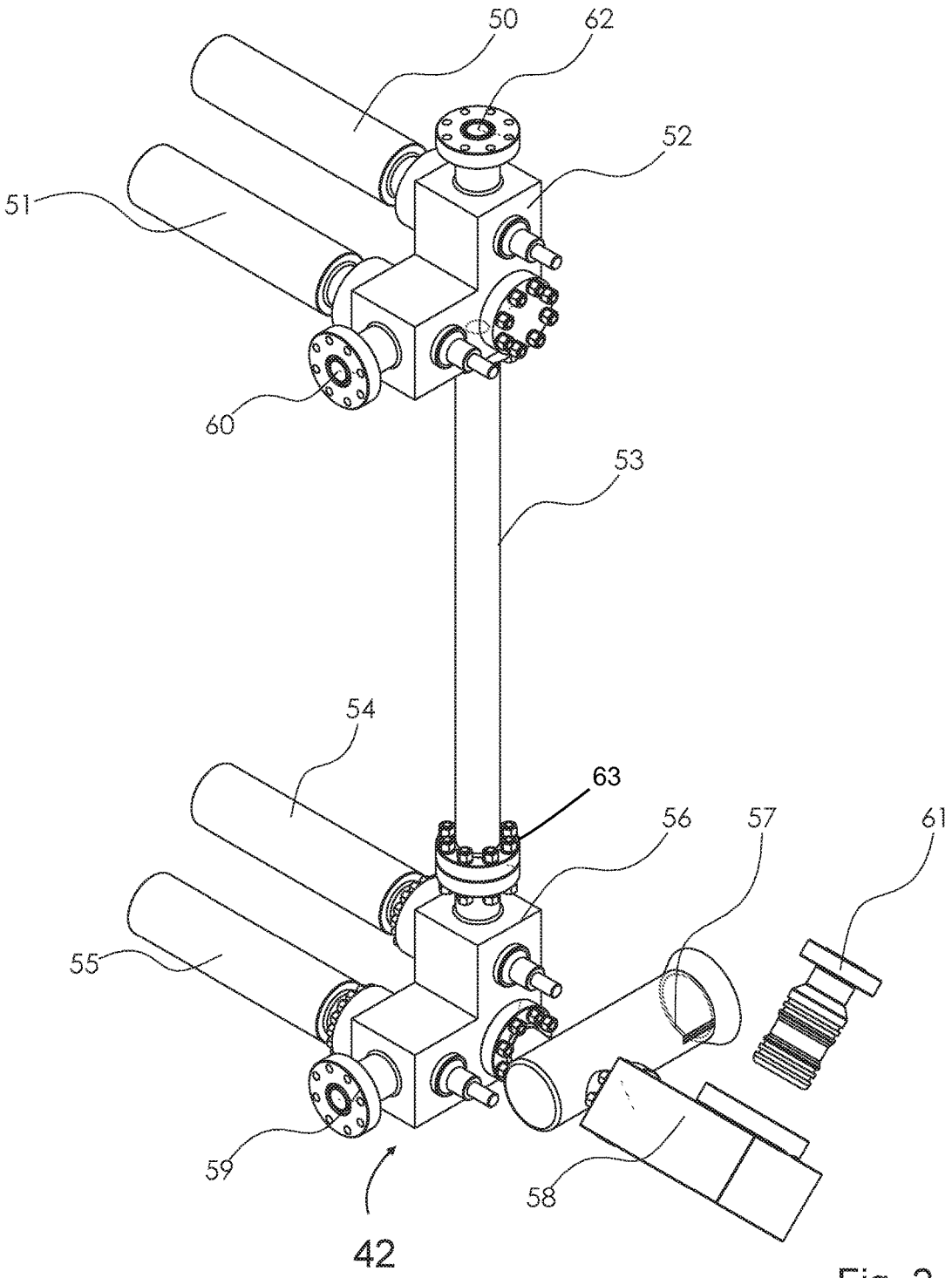
FIG. 2 shows a perspective view of a gate valve intervention assembly according to a preferred embodiment of the invention.

Turning now to FIG. 2, there is shown a perspective view of gate valve intervention assembly 42. Actuators 50 and 51 are connected to gate valve 52 which is in fluid communication with spool or pipe 53. Gate valve 52 and gate valve 56 are L-shaped with each end of the L having fluid ports for engagement. Gate valve 56 is operably connected to pipe 53 and actuators 54 and 55. Port 59 provides output of gate valve 56 when the valve is in an open position. Port 60 provides output of gate valve 52 when the valve is in an open position. Operably connected to gate valve 56 is manually operated gate valve 57 which is operable by ROV. Fluid inlet 58 is operably connected through hose connector 61 to high pressure hose fluid typically provided by a remote source.

Actuators 50, 51, 54 and 55 are well known in the art and conventional in operation and may be operable by connection to hydraulic control lines (not shown) also well known in the art by use of remote panel or ROV controlled discrete control panel. Output 62 in gate valve intervention assembly 42 is connected to the choke line, whereas the reciprocal output of assembly 44 could preferably be attached to the kill line. The operation of assemblies 42 and 44 for an intervention when normal controls are lost or disabled and when used together is more fully described below.

In certain situations, an operator is presented with a situation where there is loss control of the well through a malfunction in the choke or kill line, disconnection of portions of the BOP, leaking of the shear rams, or some catastrophic event. In operation, assemblies 42 and 44 may be used to provide control of the well and prevent or minimize a catastrophic event. A method of a preferred embodiment involves checking for pressure leaks in the BOP and plugging the annulus to prevent further fluid flow before normal control can be achieved. Fluid, preferably plugging fluid, such as either coarse lost circulation material or a gunk plug, could then be pumped above the lower shear ram 5 to block flow from the wellhead. Such fluid could preferably be flowed into cavity 10 of FIG. 1B to prevent further contamination from well formation fluids. Gate valve 12 (FIG. 1B) would then be actuated and opened on the choke line side. This would create fluid pressure on gate valve 11 that is closed in operation at this point. Actuators 51 and 54 (FIG. 2) would be activated to open gate valves 52 and 56 which in turn would permit fluid to enter cavity 10 located between upper shear ram 4 and lower shear ram 5

The next step would be to measure the drill pipe pressure and choke line pressure using conventional and well-known methods. From these pressure readings, the mud weight in for example pounds per gallon, to kill and stabilize the well may be calculated to provide the appropriate kill mud to control the well.

After plugging is accomplished as set forth above, pumping of plugging fluid would be stopped, and gate valve 57 would be remotely opened by ROV on the kill side assembly 44. Kill mud is then applied by a high pressure pump (not shown) connected to hose connector (similar to hose connector 61 of FIG. 2) on assembly 44 on the kill side of the BOP. High pressure fluid would then flow through gate valve 56 through port 63 and up spool 53 on kill side assembly 44 under lower shear ram 5 and above pipe ram 6 through port 60 situated just below lower shear ram 5. Gate valve 11 on the choke side would then be opened, actuator 54 would be closed to permit flow out of port 59 from the BOP and then out hose connector 14. Pressurized fluid flows down the drill pipe 16 and back up the outside of drill pipe 16 within casing until it flows out of connector 14. Even after activation of the shear rams, drill pipe 16 will be in fluid communication potentially with the BOP and permit fluid movement down the well and back up the casing. This circuit or flow path creates a temporary bypass and allows for controlled flow of drilling mud into the system on the kill side of the BOP and out the choke side.

The system is designed to fit all subsea Blow Out Protectors (BOP) and also the lower rams of surface floating rig BOP systems.

It can work whenever a lower marine riser package (LMRP) is disconnected or, as in the Maconda incident, even when it is still in position when the riser is damaged. It does not require the riser to be cut or anything moved as long as there is access to the connector. It will still work even after the emergency disconnect system (EDS) has closed the shear rams and even though they may not be sealing correctly.

This system allows heavier mud to be pumped into the well to provide a top cap, kill the well as per normal procedures or the influx may be bullheaded back into the formation if the situation allows. This system would also allow the use of a gunk plug to seal any problems of oil escaping into the sea.

The configuration is such that it allows an extra external connection to the wellbore in accordance to API requirements while still maintaining the integrity of the BOP.

If the well has problems, and in other situations, it may be required to disconnect the LMRP, a high pressure hose can be connected to the system to monitor the well during this period. Another similar system may be connected to the choke side for this situation and with pipe hung off in the well to allow full control of the well.

To operate in case of emergency, requires a hose connected to the balanced stab with a gooseneck that aligns the stab with the receptacle. Once the balanced plug is removed the stab can be connected manually or with a hydraulic system which can do both operations at one time. Once the connection is made, the manual gate valve can be opened along with the Lower Inner Kill Valve. The second being opened, hydraulically by use of an ROV stab. A standard for use of an ROV in a preferred embodiment is known as API 17-H.

The interface flange should be manufactured preferably from material with a minimum tensile strength of 450 MPa (65 300 psi) in order to operate at the specified torques, but the engineer is free to specify other materials where different load conditions exist.

Protection from marine growth and corrosion will be necessary in most environments, and consideration should be given to the use of corrosion-resistant materials or appropriate coatings.

The interface is approached by an ROV tool along the drive stem axis, and therefore access is required in this area.

In operation, the ROV-mounted torque tool is presented to the interface along its axis, orientated to engage the tool drive adapter on the T-bar or paddle. Once fully engaged the tool can provide continuous rotation in either direction with all torque reacted by the ROV deployment system. This interface has no built-in guidance for assisting engagement and therefore should be used in conjunction with a twin or single docking system that provides positive location of the tool head.

A rotary (high-torque) interface is shown which has a standard interface that provides for the ROV operation of subsea equipment requiring a rotary action.

The rotary interface is used in conjunction with a remote-mounted torque tool for the override or operation of subsea tree valves, SCM lock downs, running tool operation, shackle release and other functions requiring the application of high torque.

The interface consists of a square drive stem enclosed in a tubular housing with internal torque reaction lugs.

The interface is generally mounted with the drive stem horizontal but may be mounted vertically if required. The interface receptacle can be incorporated into a panel by bolting or welding, be free standing or be made as part of the subsea equipment. In the case of panel mounting, the panel should be flush with the docking face.

The interface should be manufactured from material with a minimum tensile strength of 450 MPa (65 300 psi) so that it can operate at the specified torques, but the engineer is free to specify other materials where different load conditions exist.

Protection from marine growth and corrosion will be necessary in most environments, and consideration should be given to the use of corrosion-resistant materials or appropriate coatings.

The interface is approached by the ROV tool along the drive stern axis; access is therefore required in this area.

The ROV-mounted torque tool of a preferred embodiment is presented to the interface along its axis, orientated to engage the torque reaction lugs into slots in the tool. The tool drive socket is then slowly rotated, if necessary, and moved forward to engage the drive stem. Once fully engaged the tool can provide continuous rotation in either direction with all torque reacted within the tool and interface, not into the ROV deployment system. This interface may have no built-in guidance for assisting engagement and therefore should be used in conjunction with a twin or single docking system that provides positive location of the tool head.

Linear (push) interface—Types A and C are a standard interface that provides for the ROV operation of subsea equipment requiring a push action. It is used in conjunction with an ROV-mounted tool, primarily for the override of hydraulic gate valves allowing ROV opening of the valve after fail-safe closure. In this application the interface is usually incorporated as part of the valve actuator and can be operated with the valve under pressure.

When used with the Generation "X" control system, a different auxiliary line set up can be used and an intervention port can be fitted to both the choke and kill line of the BOP. This not only allows access in the case that one side has debris in the way but can also allow complete well control without a rig on site and the ability to circulate down though the pipe in the wellbore.

All of the compositions and/or methods disclosed and claimed herein can be made and executed without undue experimentation in light of the present disclosure. While the compositions and methods of this invention have been described in terms of various embodiments, it will be apparent to those of skill in the art that other variations can be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the issued claims.

The invention claimed is:

1. An emergency gate valve intervention assembly comprising:

a first generally L-shaped gate valve assembly having a first and second port on opposite ends of the L, each end operably connected to an actuator connectable to a hydraulic control line for selectable fluid communication with a pipe engaged to the first valve;

the first gate valve in selectable fluid communication with the pipe to a second generally L-shaped gate valve assembly in selectable fluid communication with the pipe, the second valve having two ports on opposite ends of the second L, each operably connected to an actuator connectable to a hydraulic control line for selective fluid communication to the pipe; and a manually operated valve operably connected to the second gate valve for fluid engagement to a high pressure fluid source.

2. An emergency wellbore intervention assembly as claimed in claim 1 wherein the assembly has a port for engagement to a BOP.

3. An emergency wellbore intervention assembly as claimed in claim 1 further comprising hydraulic connection to a choke line through fluid communication with the second L-shaped gate assembly.

4. An emergency wellbore intervention assembly as claimed in claim 1 further comprising hydraulic connection to a kill line through fluid communication with the second L-shaped gate assembly.

5. An emergency wellbore intervention assembly as claimed in claim 4 wherein the first port of the first gate valve is operably engaged to a BOP above a shear ram.

6. An emergency wellbore intervention assembly as claimed in claim 1 further comprising a hose connector operably connected to the manually operated valve.

7. An emergency wellbore intervention assembly connected to a blow out protector (BOP) having an upper and lower shear ram comprising:

a first generally L-shaped gate valve assembly having a first and second port on opposite ends of the L, each side operably connected to an actuator connectable to a hydraulic control line for selectable fluid communication with a pipe;

the second port connected above a lower shear ram of a BOP;

the first gate valve in selectable fluid communication with the pipe to a second generally L-shaped gate valve in selectable fluid communication with the pipe, the second gate valve having a third and fourth port on opposite ends of the second L, each operably connected to an actuator connectable to a hydraulic control line for selective fluid communication to the pipe;

the fourth port connected below the lower shear ram of a BOP; and a manually operated valve operably connected to the second gate valve for fluid engagement to a high pressure fluid source.

8. An emergency wellbore intervention assembly as claimed in claim 7 further comprising a hose connector operably connected to a manually operated valve.

9. An emergency wellbore intervention assembly as claimed in claim 7 wherein the second port is operably engaged below the lower shear ram.

10. An emergency wellbore intervention assembly as claimed in claim 7 further comprising engagement to a choke line through fluid communication with the second L-shaped gate assembly.

11. An emergency wellbore intervention assembly as claimed in claim 7 further comprising engagement to a kill line through fluid communication with the annulus.

12. A method for use of an emergency wellbore intervention assembly on a blow out preventer (BOP) having an annulus with drill pipe disposed therein comprising the steps of:

plugging the annulus with pumping fluid above the lower shear ram to prevent fluid flow;

measuring the drill pipe pressure and choke line pressures;

calculating the mud weight to kill and stabilize the well based on the drill pipe pressure;

engaging below a lower shear ram and above a pipe ram on a kill side of a BOP a first generally L-shaped gate valve assembly having a first and second port on opposite ends of the L, the gate valve selectively operable by an actuator controlled by a hydraulic line to engage the BOP through said second port;

applying kill mud from a high pressure source through a second L-shaped gate valve assembly in fluid communication with the first L-shaped gate valve assembly; and engaging a third L-shaped gate valve assembly having a third and fourth port on a choke side of the BOP, the fourth port below the upper pipe ram to create a flow path to a choke line in fluid communication with the fourth port upon engagement of the third gate valve to permit flow of kill mud to the surface through a choke line established through the fourth port.

13. A method for use of an emergency wellbore intervention assembly on a blow out preventer (BOP) as claimed in claim 12, further comprising the step of connecting a high pressure pump to the second gate valve assembly.

14. A method for use of an emergency wellbore intervention assembly on a blow out preventer (BOP) as claimed in claim 13, further comprising the step of opening the first gate valve assembly and engaging the drill pipe.

15. A method for use of an emergency wellbore intervention assembly on a blow out preventer (BOP) as claimed in claim 13, further comprising the step of hydraulically operating at least one the gate valves.

16. A method for use of an emergency wellbore intervention assembly on a blow out preventer (BOP) as claimed in claim 13, wherein the pumping fluid is coarse lost circulation material.

17. A method for use of an emergency wellbore intervention assembly on a blow out preventer (BOP) as claimed in claim 13, wherein the pumping fluid comprises a gunk plug.

18. A method for use of an emergency wellbore intervention assembly on a blow out preventer (BOP) as claimed in claim 13, wherein the gate valve assemblies are operable by ROV.

* * * * *